United States Patent [19]

Tibolla

[11] 4,242,552

[45] Dec. 30, 1980

[54] MOUNTING MEANS FOR INTERCHANGEABLE SWITCH HANDLES

[75] Inventor: Julius F. Tibolla, Yardley, Pa.

[73] Assignee: GTE Sylvania Wiring Devices, Inc., Trenton, N.J.

[21] Appl. No.: 1,496

[22] Filed: Jan. 8, 1979

[51] Int. Cl.[3] ..... H01H 3/20; H01H 3/00

[52] U.S. Cl. ..... 200/339; 200/330

[58] Field of Search ..... 200/339, 330, 331, 296; 248/27.1, 27.3

[56] References Cited

U.S. PATENT DOCUMENTS

| | | | |
|---|---|---|---|
| 2,794,890 | 6/1957 | Taylor | 200/172 |
| 3,435,169 | 3/1969 | Bienwald et al. | 200/339 X |
| 3,501,599 | 3/1970 | Horecky | 200/16 |
| 3,535,478 | 10/1970 | Lewis | 200/67 |
| 3,562,468 | 2/1971 | Stefani | 200/168 |
| 3,582,584 | 6/1971 | Best | 200/67 |
| 3,598,950 | 8/1971 | Ohashi | 200/167 A |
| 3,651,296 | 3/1972 | Yarbrough | 200/167 A |
| 3,670,121 | 6/1972 | Howe | 200/67 G |
| 3,681,556 | 8/1972 | Osika | 200/172 A |
| 3,684,847 | 8/1972 | Hoehn et al. | 200/67 A |
| 4,000,383 | 12/1976 | Lockard | 200/16 D |

*Primary Examiner*—Steven M. Pollard

*Attorney, Agent, or Firm*—Frederick A. Zoda; John J. Kane; Albert Sperry

[57] ABSTRACT

An electrical switch has an operating handle which snaps onto a housing assembly, and when so attached is rockably mounted in engagement with a switch actuator projecting forwardly from the face of the assembly. The handle is formed with tapered projections at opposite sides, which resiliently yield upon insertion of the handle through the opening of a conventional wall plate and engage in back of the wall plate immediately prior to movement of the switch into its pivotal mounting on the housing assembly, to deter those who would casually and without authorization detach the handle from the housing assembly assembly. Removal of the wall plate permits the handle to be detached, to facilitate selection and interchangeability of handles according to a particular room decor or other aesthetic considerations.

9 Claims, 8 Drawing Figures

MOUNTING MEANS FOR INTERCHANGEABLE SWITCH HANDLES

BACKGROUND OF THE INVENTION

1. Field of the Invention

The invention relates generally to electrical switches, usually but not necessarily of the general purpose type mounted on room walls for the purpose of controlling lighting circuits. In a more particular sense, the invention has particular reference to switches of the type utilizing rockable handles. The invention may be classified with those switches in this category, wherein the handles are separably attached to the housings or bodies of the switches, to facilitate swift and easy interchange of handles, so that handles may not only be selected or match or harmonize with the room decor decided upon when the switches are initially installed, but also, can be interchanged whenever the decor of the room, in particular the wall treatment, is changed after said initial installation.

2. Description of the Prior Art

The broad concept of electrical switches designed to facilitate handle replacement for decorative purposes, is known, and may be seen in such patents as U.S. Pat. Nos. 3,598,950; 3,681,556; and 4,000,383.

The switches of the prior art, however, have left something to be desired, in that they have not been particularly well suited, by reason of the construction incorporated therein, for use in the typical type of switch mounting that is found in residential or commercial establishments, on room walls of the residential or commerical structure, wherein it is often desired that the switch match or harmonize with colors selected for the room decor.

In such cases, the typical switch mount includes a conventional wall plate, which is detachably connected by mounting screws to the mounting strap of the installed switch. The switch is mounted in a conventional outlet box. The particular dimensions, mounting, wall plate construction, and indeed, every design aspect, and every functional and electrical consideration involved in the switch construction and mounting, are very strictly controlled by building and electrical codes, industry standards, and Underwriters Laboratories requirements. Compliance with all of these is essential if a switch is to be marketed commercially in this country. In other countries as well, similar standards exist and if they do not duplicate those of the United States, at least come very close to the standards established for this country and are followed by all recognized manufacturers of electrical switches of this type.

In switch installations of the character described, the swift and easy interchangeability of handles, particularly large, decorative rocker handles, becomes very important. The handles should be readily interchangeable without the requirement of special tools, that is, the handles should be capable of being removed merely by being grasped and pulled off the housing assembly, and should in turn be capable of attachment to the housing assembly with equal speed and ease, and without requirement of special tools.

This, of course, refers to the authorized removal and attachment of handles. While facilitating such removal and reattachment of handles, it is also important that unauthorized removal be discouraged, that is, when the selected handle is in place and is operative with respect to the switch mechanism, with a wall plate secured to the switch in proper relation to the handle, one should not be able to casually and easily detach the handle. Yet, such detachment should be quickly and easily accomplished, when authorized, following deliberate removal of the wall plate mounting screws and the entire wall plate for the purpose of exposing the switch within the outlet box.

The prior art has not, so far as is known, addressed itself to this particular problem or deficiency in switches as heretofore constructed.

It is also desirable, in installations of the type described, that the user be permitted, should he so choose, to snap the rocker handle into place after the wall plate has been attached to the housing assembly, in an arrangement in which, thereafter, the handle cannot be removed unless the wall plate is physically detached by removal of the wall plate mounting screws.

SUMMARY OF THE INVENTION

Summarized briefly, the invention has been particularly disclosed with reference to general purpose wall switches, particularly those of the AC type. However, as will be apparent the invention is also applicable to appliance switches, in situations where separable cover plates are associated with the appliance and with the switch mountings incoporated in said appliances. Accordingly, as used herein the term "wall plate" or "cover plate" will be understood as referring not only to those wall plates which are conventionally installed in covering relation to general purpose wall switches used in residences and commercial establishments, but will also be understood as having reference to switches mountable in control panels, or mountable in decorative installations such as kitchen ranges and ovens and other appliances or equipment in which it may be desired to select switch handles according to the particular colors of the equipment, and in which the swift attachment or detachment of the handles, particularly large rocker handles, is to be facilitated.

The invention, for this purpose, incorporates at opposite sides of a large rocker handle, tapered, generally conical lugs, adapted to yield resiliently when pressed past the side edges of a previously installed wall plate or cover plate, so as to engage in back of the plate and thereafter prevent removal of the switch handle upon deliberate detachment of the plate itself. The switch handle, further, has a separable, snap-in pivotal connection with the housing assembly previously installed and accessible through the handle opening of the wall plate. The separable pivotal connection of the handle and the housing assembly of the switch is completed following the movement of the lugs past the wall plate, said lugs moving well in back of the wall plate so as to thereafter allow free rockable travel of the handle during regular use of switch.

The invention, though described specifically with reference to a large, generally flat rocker handle of the type having only a few degrees of angular travel, may be incorporated with equal facility in handles of the so-called toggle type, having forwardly projecting handle levers or arms. The handle, further, though illustrated with reference to a capability thereof to rock a pivotally mounted switch mechanism actuator, can be readily applied, as will be apparent, to other types of mechanisms, as for example slide switch mechanisms such as shown by way of example in the above-mentioned U.S. Pat. No. 4,000,383.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
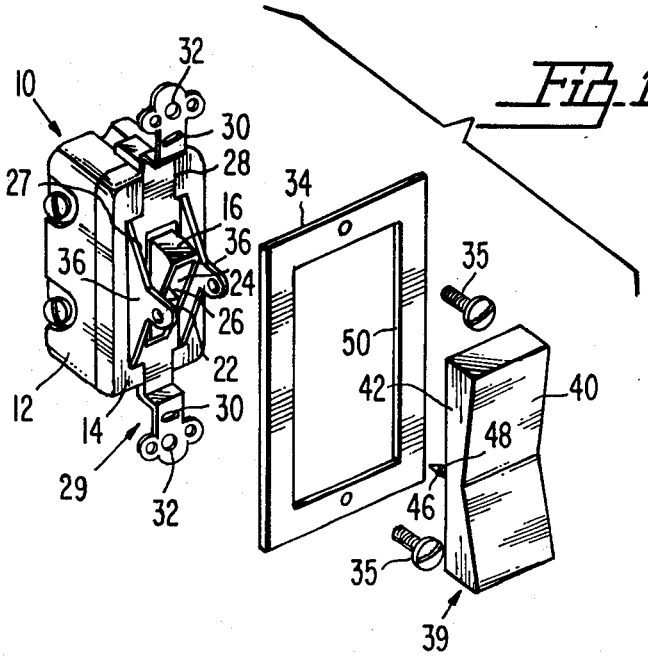
FIG. 1 is an exploded perspective view of a general purpose wall switch and wall plate, in which there has been embodied the improved handle mounting comprising the present invention.

In the illustrated example of the switch improvement comprising the present invention, a general purpose AC wall switch has been designated by the reference numeral 10, and in the illustrated example is provided with a body 12 of electrically insulative material, and a cover 14 of the same material.

Figure 2:
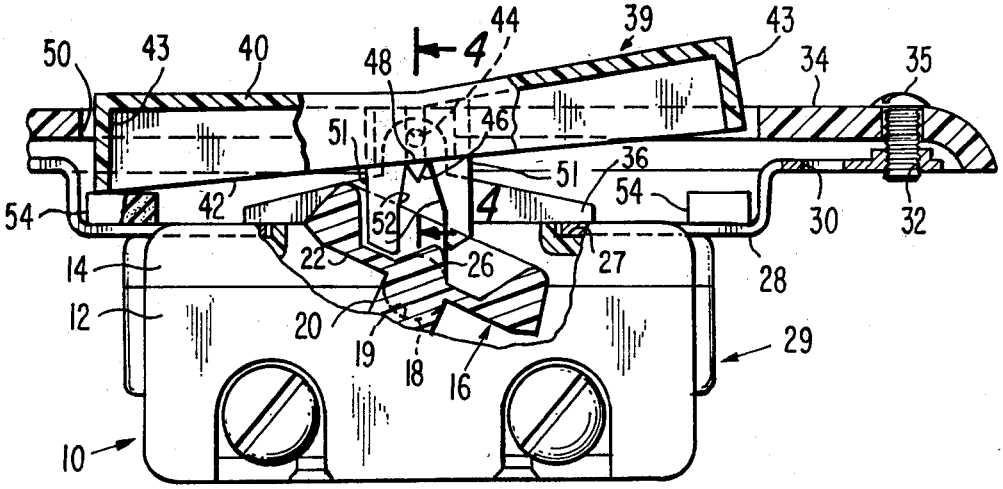
FIG. 2 is an enlarged view, partly in side elevation and partly in longitudinal section, portions being broken away, of the fully assembled switch housing assembly, handle, and wall plate.

Within the body there is provided a switch mechanism, which is not shown except for the disclosure of an actuator 16 (see FIG. 2), also of electrically insulative material, and mounted for rocking movement within the housing through the provision of trunnions 18 of the actuator seating in bearing recesses 19 provided in the opposite side walls of the body and the cover.

The actuator is provided with a depending cam 20, molded integrally with the trunnions 18 and with a generally rectangular head 22 having an upwardly opening, also generally rectangular recess 24 in the center of which there is integrally molded an upwardly projecting tongue 26. A mounting strap 28 seats in a complementary, shallow recess 27 formed in the cover, and with the body 12 and cover 14 defines a housing assembly generally designated 29.

Strap 28, at its opposite ends, has forwardly offset extensions, in which are formed transversely elongated openings or mounting slots 30, adapted to receive mounting screws, not shown, whereby the housing assembly is attachable to and seats within a conventional electrical outlet box, not shown. Also formed in the forwardly offset end portions of the mounting strap are threaded openings 32 for receiving the mounting screws of an electrical wall plate 34, said screws being designated 35.

At this point, it may be noted that the switch body, cover, mounting strap, and the general concept of a rockable actuator having a cam means for deflecting switch contacts, is of course well known and does not constitute part of the present invention, being disclosed, for example, in patents such as that issued to Bentley, U.S. Pat. No. 2,725,438. The application of John M. Genovese, Ser. No. 1,495 filed concurrently herewith, relates to improvements in the operating mechanisms of switches of this type, which improvements incorporate the particular actuator and handle disclosed in the present application.

Also conventional is the wall plate 34 and the attachment of the wall plate to the mounting strap by means of the screws 35.

The present invention relates to a mounting means and anti-removal means for a switch handle, usable in association with a completely conventional wall plate 34 and with a switch actuator having means such as the tongue 26 engageable by the handle for the purpose of imparting movement of the switch actuator between selected operating positions, responsive to rocking of the handle.

The present invention is concerned with improvements in the switch handles and the mounting means for the handles, especially with respect to arrangements involving removable cover plates or wall plates such as the wall plate 34. To this end, the mounting strap 28 is formed with transversely aligned, forwardly projecting bearing plates 36, integral with the strap and disposed medially between the opposite ends of the strap. The bearing plates 36 are formed (see FIG. 3) with inwardly pressed dimples or low, conical bearing projections 38, adapted to provide pivotal supports for a large rocker handle generally designated 39. Handle 39, in the illustrated example, is formed with a front wall or body 40 molded to define a shallow obtuse angle.

The rocker handle is also molded integrally with side walls 42 and end walls 43 which in the illustrated example, on throw of the handle in opposite directions, engage soft rubber bumpers 54. There may if desired be only a single bumper, or no bumpers at all, depending upon the type of internal contact mechanism selected.

Partitions 45, molded integrally with body 40, have outwardly facing, shallow, bearing recesses 44, which receive the projections 38 of bearing plates 36.

Figure 6:
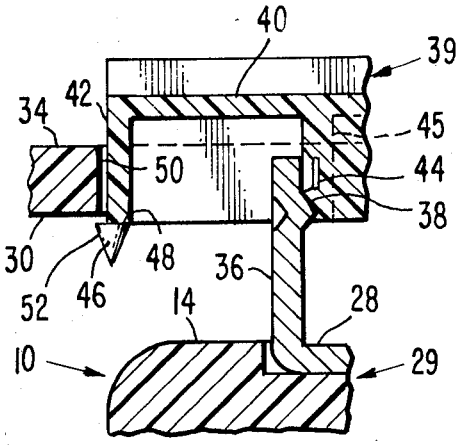
Figure 7:
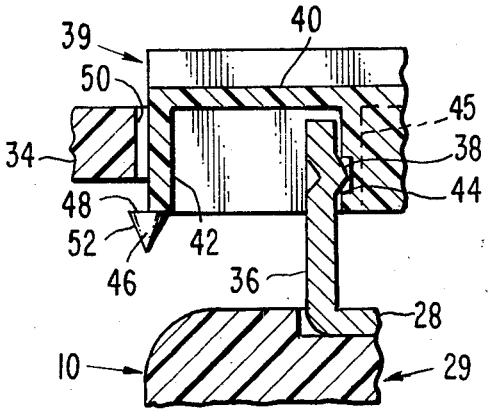

This arrangement permits the rocker handle to be snapped onto the bearing plates. The partitions 45 of the rocker handle are adapted to yield, resiliently, in these circumstances, being deflected inwardly slightly (see FIG. 6) as the handle is snapped onto the bearing plates, and thereafter returning to their normal position as illustrated in FIG. 7. In this position, the handle is effectively mounted upon the bearing plates, for rocking movement between its opposite extreme positions, so as to in turn rock the actuator between different operating positions thereof.

Figure 3:
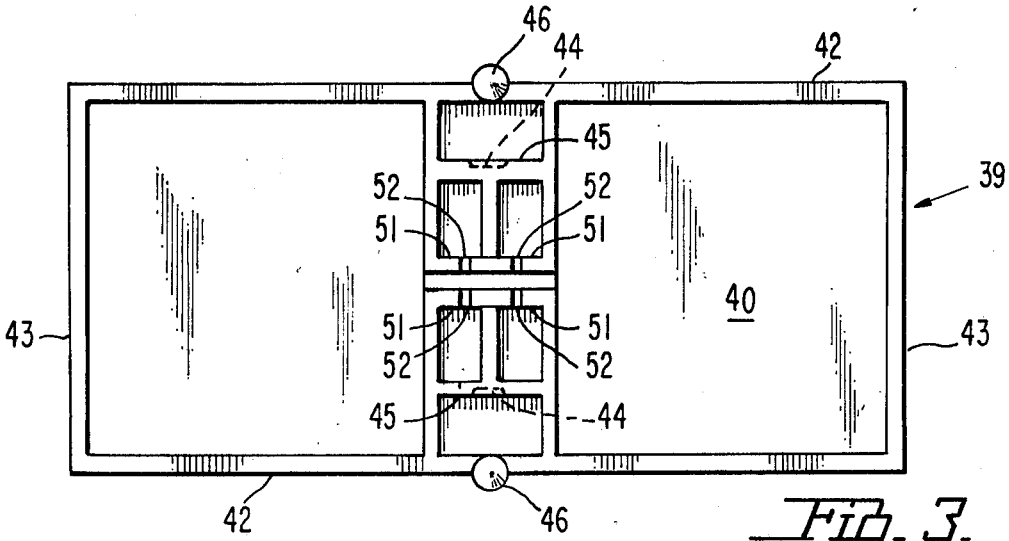
FIG. 3 is a bottom plan view of the handle per se.
Figure 4:
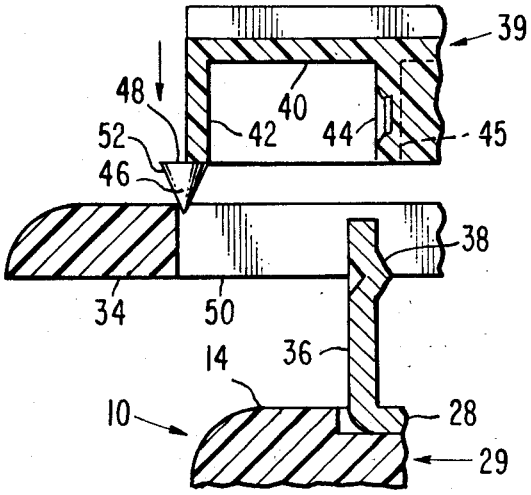
FIGS. 4 through 7 are detail transverse sectional views substantially on line 4—4 of FIG. 2, in which the handle is illustrated at successively following stages during the snap-in mounting thereof.

As seen from FIGS. 1 and 3, molded integrally with the handle, on the side walls 42 thereof, are rearwardly facing, conical lugs 46. Lugs 46 are tapered elements, which in the illustrated example are conically formed, although it is believed that they could be in the form of right-triangular members, or may be otherwise formed so long as they define, in the fully installed positions of the switch body, wall plate, and handle, forwardly facing abutments 48 underlying the wall plate and spaced rearwardly from the wall plate as shown in FIG. 3, at the opposite side edges of the large, rectangular wall plate opening 50.

In use of the invention, the switch housing assembly 29, fully assembled in the manner shown in FIG. 1, is first installed in the electrical outlet box, not shown, through the provision of mounting screws, also not shown, extendable through the mounting slots 30 into threaded openings formed in the usual ears located at the opposite ends of the outlet box.

At this time, it may be desired to await inspection of the installation by an electrical inspector, where the switch is being installed in a new building or building improvement requiring such inspection. Thereafter, one may select the room decor, in particular the wall colorings or color combinations, after which the user can select a particular handle 40 that matches with or harmonizes with the decor. The handle is then snapped onto the bearing plates 36, a step which is carried out swiftly and easily, without the use of any spcial tools. Thereafter, one can apply a wall plate 34, which again is capable of being selected according to the particular room decor. The wall plate 34 may be applied last, and when so applied is in the position shown in FIGS. 2 and 7 in relation to the previously attached handle 39. In these circumstances, the handle 39 cannot be removed without authority, except by first removing the wall plate itself. While this obviously does not represent an absolute prevention of unauthorized removal of the wall plate, the arrangement serves the important purpose of deterring such removal, since normally, mischievous children or vandals would not be aware that the handle can be removed by backing out the screws 35, removing the wall plate 34, and then detaching the handle. Instead, any casual, unauthorized attempt to remove the handle 39 would be prevented by engagement of the abutments 48 against the back surface of the wall plate 34.

Of course, whenever it is desired to remove the handle for the purpose of attaching a new one (which may be desired if, for instance, the room decor is changed at a later date), this is easily achieved by removing the wall plate 34, snapping out the old handle, and snapping a new handle into place. Wall plate 34 is then reattached, or alternatively, a new wall plate, matching or harmonizing with the new handle and room colors, is used.

Figure 5:
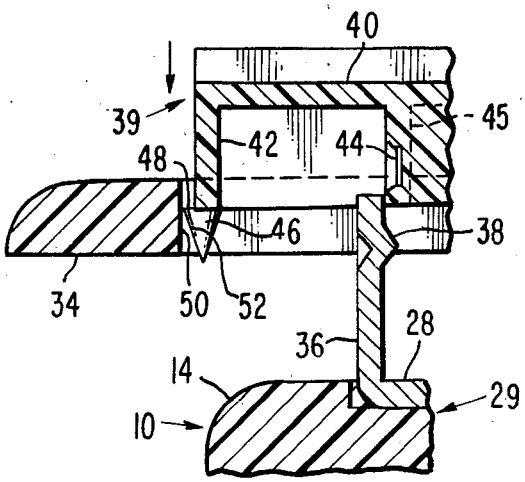

It is also possible to snap the handle 39 into place after attachment of the wall plate, should this be desired. This is shown in FIGS. 4–7. The side edges of opening 50 are so located that upon insertion of the handle through the wall plate opening, the side edges of the opening will initially contact the tapered or inclined outer surfaces 52 of the lugs 46 (see FIG. 4). The side edges of the wall plate opening, in these circumstances, will exert a cam action against the tapered outer surfaces of the lugs, as shown in FIG. 5. The side walls 42 will be resiliently biased inwardly to a slight extent to permit the lugs to be cammed inwardly, and further inward movement of the handle is thereafter effective to cause the lugs to move to a position fully in back of the wall plate (FIG. 6). As they move to that position, the projections 38 begin to exert a cam action on the partitions 45, so that the partitions are now biased inwardly to a very slight degree, until the bearing recesses 44 register with the projections 38 of bearing plates 36 and the handle snaps fully into place.

At this time, the lugs 46 are well in back of the wall plate 34 as shown in FIG. 6. Abutments 48, while remaining effective to prevent removal of the handle, are spaced rearwardly from the wall plate sufficiently to be completely clear of the wall plate during the rocking motion of the handle between its opposite extreme positions, thus offering no interference of any kind to normal throw of the handle in opposite directions.

Figure 8:
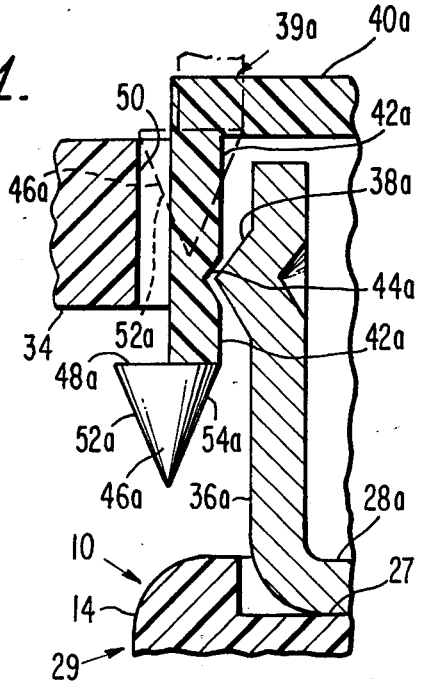
FIG. 8 is an enlarged, detail sectional view on the same cutting plane as FIGS. 4–7 showing a modified construction.

As exemplified by the form of the invention shown in FIG. 8, the pivotal mounting of the handle **39*a* can be provided on the side walls 42*a* rather than on partitions located inwardly from the side walls. In this modification, upon insertion of the handle 39*a* through the wall plate openings 50, the side edges of the wall plate opening will initially contact the tapered or inclined outer surfaces 52*a* of the lugs 46*a*. The side edges of the wall plate opening, in these circumstances, will exert a cam action against the tapered outer surfaces of the lugs, as shown in the chain dotted lines of FIG. 8. The side walls 42*a* will be resiliently biased inwardly to a slight extent to permit the lugs to be cammed inwardly, and rearward movement of the handle is thereafter effective to cause the lugs to move to a position fully in back of the wall plate. As they move to that position outwardly facing projections 38*a* of bearing plate 36*a* formed on strap 28*a* begin to exert a cam action on the inner tapered or inclined surfaces 54*a* of the lugs, so that the walls 42*a* are now biased outwardly to a very slight degree, until the inwardly opening bearing recesses 44*a* register with the projections 38*a* of bearing plates 36*a*** and the handle snaps fully into place.

At this time, the lugs **46*a* are well in back of the wall plate 34 as shown in full lines in FIG. 8. Abutments 48*a***, while remaining effective to prevent removal of the handle, are spaced rearwardly from the wall plate sufficiently to be completely clear of the wall plate during the rocking motion of the handle between its opposite extreme positions, thus offering no interference of any kind to normal throw of the handle in opposite directions.

I claim:

1. In an electrical switch-and-coverplate structure of the type that includes a switch having a housing assembly and an actuator movably supported thereby, and a cover plate removably attached to said assembly and having an opening providing access to the actuator and the housing assembly and having opposite side edges, an improved handle and mounting means therefor comprising:

(a) a switch handle adapted to be disposed within said opening, said handle having opposite sides in close proximity to the respective side edges of the cover plate opening;

(b) means on the housing assembly and handle respectively, providing a separable snap type pivotal connection therebetween for rockably connecting the handle to the housing assembly in position to move the actuator responsive to rocking of the handle by a user, said means being adapted to effect the snap connection of the housing assembly to the handle in response to movement of the handle in a direction rearwardly toward the assembly both with and without the cover plate attached, and the snap disconnection thereof responsive to exertion of a pulling force in the opposite direction with the cover plate removed; and (c) means separate from the first named means and mounted upon the handle at the respective, opposite sides thereof laterally outwardly from the first named means, said second means providing forwardly facing abutments disposed in confronting relation to the opposite side edges of the cover plate opening whereby said side edges constitute surfaces engageable by the abutments to prevent separation of the housing assembly and handle and consequent removability of the handle through the cover plate opening whenever the cover plate is attached to the housing assembly, said second named means leading the first named means in the sense of said movement of the handle in the rearward direction, said second named means arriving at a final position in which the side edges of the cover plate opening are engageable by said abutments of the second named means, prior to relative movement of the first named means on the handle assembly and handle at a final position in which they provide said pivotal connection between the handle assembly and handle.

2. In an electrical switch-and-cover-plate structure, an improved handle and mounting means therefor as in claim 1 wherein the means providing a pivotal connection between the handle and the housing assembly comprises transversely aligned projections on the housing assembly, and recesses on the handle adapted to receive said projections.

3. In an electrical switch-and-cover-plate structure, an improved handle and mounting means therefor as in claim 1 wherein said means for preventing removal of the handle comprises a pair of lugs respectively disposed at the opposite sides of the handle in position to extend below the respective opposite side edges of the cover plate opening.

4. In an electrical switch-and-cover-plate structure, an improved handle and mounting means therefor as in claim 3 wherein the handle is insertable through the cover-plate opening with the cover plate attached, said lugs being adapted to be yieldably, resiliently biased inwardly by the side edges of the cover plate opening upon said insertion of the handle and being adapted to snap under said side edges when the handle is fully inserted.

5. In an electrical switch-and-cover-plate structure, an improved handle and mounting means therefor as in claim 4 wherein the means for separably, pivotally connecting the handle to the housing assembly comprises projections on the housing assembly, the handle having recesses in which said projections are engageable in response to said insertion of the handle through the cover plate opening and after said lugs snap under the side edges of the cover plate opening.

6. In an electrical switch-and-cover-plate structure, an improved handle and mounting means therefor as in claim 5 wherein the lugs have first ends that are leading in the sense of the direction of movement of the handle when the handle is inserted through the cover plate opening, the lugs having second ends formed with shoulders extending laterally outwardly from the sides of the handle to engage under the respective side edges of the cover plate opening, said lugs tapering from said second ends toward the first ends thereof to define cam surfaces engageable by the side edges of the cover plate opening when the handle is inserted for biasing of the lugs inwardly by said side edges.

7. In an electrical switch-and-cover-plate structure of the type that includes a housing, an actuator mounted in the housing for movement between different operating positions and having a tongue means projecting exteriorly of the housing, a mounting strap secured to the housing and having an aperture through which said actuator extends, said strap including a pair of bearing plates respectively disposed at opposite sides of the actuator, and a cover plate removably connected to the strap and having an opening through which access may be had to the actuator and said bearing plates, said opening having side edges disposed adjacent the respective bearing plates, an improved handle and mounting means therefor comprising:

(a) a handle body occupying substantially the entire area of the opening of the cover plate, said handle body overlying and concealng the bearing plates and actuator, said handle body being adapted for operation by a user and having side walls respectively disposed adjacent the bearing plates;

(b) means on the handle and bearing plates separably engageable with each other to provide a readily detachable, pivotal mounting of the handle body on the bearing plates, said handle body having an underside formed with a recess loosely receiving the tongue means of the actuator in the mounted position of the handle body whereby pivotal motion imparted to the mounted handle body by a user will be translated into movement of the actuator between said different operating positions thereof; and (c) a pair of lugs on the respective side walls of the handle body, said lugs extending laterally outwardly from the handle body under the respective side edges of the cover plate opening so as to prevent removal of the handle from the mounting strap whenever the cover plate is attached while leaving the handle free for separation from the bearing plates upon removal of the cover plate, said lugs being in the form of tapered elements adapted to be resiliently biased inwardly by the side edges of the cover plate opening, responsive to insertion of the handle through the cover plate opening to a position in which the tongue means engages in the recess of the handle body and the means on the handle body and bearing plates engage to provide the separable pivotal mounting of the handle body on the bearing plates, said lugs having abutments that engage under the side edges of the cover plate opening after the handle body is pivotally attached to the bearing plates and the lugs have cleared the side edges of the cover plate opening, to prevent removal of the handle whenever the cover plate is attached to the mounting strap, said lugs leading the pivotal mounting means of the handle body and bearing plates in the sense of the direction movement of the handle body during said insertion thereof through the cover plate opening, said lugs arriving at a final position, in which the abutments thereof have cleared and have engaged under the side edges of the cover plate opening, prior to arrive of the pivotal mounting means of the handle body and bearing plates at a final position in which they engage to provide said pivotal mounting means of the handle body on the bearing plates.

8. In an electrical switch-and-cover-plate structure of the type that includes a housing, an actuator mounted in the housing for movement between different operating positions and having a tongue means projecting exteriorly of the housing, a mounting strap secured to the housing and having an aperture through which said actuator extends, said strap including a pair of bearing plates respectively disposed at opposite sides of the actuator, and a cover plate removably connected to the strap and having an opening through which access may be had to the actuator and said bearing plates, said opening having side edges disposed adjacent the respective bearing plates, an improved handle and mounting means therefor comprising:

(a) a handle body occupying substantially the entire area of the opening of the cover plate, said handle body overlying and concealing the bearing plates and actuator, said handle body being adapted for operation by a user and having side walls respectively disposed adjacent the bearing plates;

(b) means on the handle and bearing plates separably engageable with each other to provide a readily detachable, snap-type pivotal mounting of the handle body on the bearing plates, said handle body having an underside formed with a recess loosely receiving the tongue means of the actuator in the mounted position of the handle body whereby pivotal motion imparted to the mounted handle body by a user will be translated into movement of the actuator between said different operating positions thereof; and (c) a pair of lugs on the respective side walls of the handle body, said lugs extending laterally outwardly from the handle body under the respective side edges of the cover plate opening so as to prevent removal of the handle from the mounting strap whenever the cover plate is attached while leaving the handle free for separation from the bearing plates upon removal of the cover plate, the handle including surfaces spaced laterally inwardly from the side walls thereof and formed with said means on the handle pivotally mounting the handle body on the bearing plates, the lugs being provided with cam surfaces, a cam surface of each lug being engageable by the side edges of the cover plate opening upon insertion of the handle in the cover plate opening, for temporary biasing of the side walls of the handle inwardly to allow the lugs to clear the cover plate and engage in back of the cover plate in the fully inserted position of the handle body after passage beyond the side edges of the cover plate opening, the means on the bearing plates that provide the pivotal mounting of the handle body on the bearing plates being adapted to cammingly bias said handle surfaces upon passage of the lugs beyond the side edges of the cover plate opening, the biasing of said handle surfaces by the bearing plate means being effective to register and pivotally interengage the means on the handle body and bearing plates that provide the mounting of the handle body on the bearing plates, in said fully inserted position of the handle body, the lugs leading the pivotal mounting means of the handle body in the sense of the direction of the movement of the handle body when being inserted in the cover plate opening, the lugs arriving at final positions clear of the cover plate prior to pivotal engagement of the mounting means of the handle body and bearing plates.

9. In an electrical switch-and-cover-plate structure of the type that includes a housing, an actuator mounted in the housing for movement between different operating positions and having a tongue means projecting exteriorly of the housing, a mounting strap secured to the housing and having an aperture through which said actuator extends, said strap including a pair of bearing plates respectively disposed at opposite sides of the actuator, and a cover plate removably connected to the strap and having an opening through which access may be had to the actuator and said bearing plates, said opening having side edges disposed adjacent the respective bearing plates, an improved handle and mounting means therefor comprising:

(a) a handle body occupying substantially the entire area of the opening of the cover plate, said handle body overlying the concealing the bearing plates and actuator, said handle body being adapted for operation by a user and having side walls respectively disposed adjacent the bearing plates;

(b) means on the handle and bearing plates separably engageable with each other to provide a readily detachable, pivotal mounting of the handle body on the bearing plates, said handle body having an underside formed with a recess loosely receiving the tongue means of the actuator in the mounted position of the handle body whereby pivotal motion imparted to the mounted handle body by a user will be translated into movement of the actuator between said different operating positions thereof; and (c) a pair of lugs on the respective side walls of the handle body, said lugs extending laterally outwardly from the handle body under the respective side edges of the cover plate opening so as to prevent removal of the handle from the mounting strap whenever the cover plate is attached while leaving the handle free for separation from the bearing plates upon removal of the cover plate, the lugs being provided with cam surfaces at opposite sides of each lug, one cam surface of each lug being engageable by the side edges of the cover plate opening upon insertion of the handle in the cover plate opening, for temporary biasing of the side walls of the handle inwardly to allow the lugs to clear the cover plate and engage in back of the cover plate after passage beyond the side edges of the cover plate opening, the other cam surface of each lug being engageable by the means on the bearing plates that provide the pivotal mounting of the handle body on the bearing plates, following passages of the lugs beyond the side edges of the cover plate opening, the second named cam surfaces of the lugs, when engaged by said means of the bearing plates, being adapted to effect biasing of the side walls of the handle body outwardly in a direction opposite to that in which the side walls of the handle body are biased when the first named cam surfaces of the lugs are engaged by the side edges of the cover plate opening, the outwardly biasing of the side walls of the handle body by the bearing plate means being effective to register the means on the handle body and bearing plates that provide pivotal mounting of the handle body on the bearing plates in the fully inserted position of the handle body.

* * * * *